US006513874B1

(12) United States Patent
Sander et al.

(10) Patent No.: US 6,513,874 B1
(45) Date of Patent: Feb. 4, 2003

(54) CHAIR, ESPECIALLY OFFICE CHAIR

(75) Inventors: Armin Sander, Fuerth (DE); Martin Potrykus, Bamberg (DE)

(73) Assignee: Konig & Neurath AG, Karben (DE)

( * ) Notice: Subject to any disclaimer, the term of this patent is extended or adjusted under 35 U.S.C. 154(b) by 22 days.

(21) Appl. No.: 09/597,347

(22) Filed: Jun. 19, 2000

(30) Foreign Application Priority Data

Jun. 17, 1999 (DE) ..... 299 10 620

(51) Int. Cl.[7] ..... A47C 1/024

(52) U.S. Cl. ..... 297/300.2; 297/300.4; 297/298; 297/320

(58) Field of Search ..... 297/300.1–300.7, 297/320, 316, 317, 301.1, 301.5, 298, 321

(56) References Cited

U.S. PATENT DOCUMENTS

| | | | | | |
|---|---|---|---|---|---|
| 2,859,799 | A | * | 11/1958 | Moore | 297/300.5 |
| 4,773,706 | A | * | 9/1988 | Hinrichs | 297/300.5 |
| 4,779,925 | A | * | 10/1988 | Heinzel | 297/300.4 |
| 5,150,948 | A | * | 9/1992 | Volkle | 297/301.1 |
| 5,308,144 | A | * | 5/1994 | Korn | 297/300.2 |
| 5,660,439 | A | * | 8/1997 | Unwalla | 297/316 |
| 5,931,531 | A | * | 8/1999 | Assmann | 297/316 |

FOREIGN PATENT DOCUMENTS

| | | | | |
|---|---|---|---|---|
| DE | 3605809 | * | 8/1997 | 297/300.2 |
| EP | 549026 | * | 4/1992 | 297/300.2 |

* cited by examiner

*Primary Examiner*—Lanna Mai
*Assistant Examiner*—Winnie Yip
(74) *Attorney, Agent, or Firm*—Laurence A. Greenberg; Werner H. Stemer; Ralph E. Locher

(57) ABSTRACT

A chair (1, 1'), in particular an office chair, having a backrest (6) which is arranged such that it can be rotated about a first point of rotation (8) in relation to a seat carrier (2) and which can be inclined from a rest position, and having a seat surface (10) which is connected to the backrest (6) such that it can be rotated about a second point of rotation (12) and which can be inclined synchronously with the backrest, is intended, in particular in terms of its tendency to tilt, also to be suitable for a particularly pronounced inclination movement of the backrest (6) with an inclination of, for example, up to 40° in relation to the starting position of the same. For this purpose, according to the invention, in the rest position, the first point of rotation (8) is positioned at approximately the same height as, or higher than, the second point of rotation (12).

20 Claims, 3 Drawing Sheets

CHAIR, ESPECIALLY OFFICE CHAIR

BACKGROUND OF THE INVENTION

FIELD OF THE INVENTION

The invention relates to a chair, in particular an office chair, having a backrest which is arranged such that it can be rotated about a first point of rotation in relation to a seat carrier and which can be inclined from a rest position, and having a seat surface which is connected to the backrest such that it can be rotated about a second point of rotation and which can be inclined synchronously with the backrest.

Such a chair is known, for example, from European Patent Application EP 0 888 739 A2. In the known chair, both the backrest and the seat surface, which is connected rotatably thereto, are designed such that they can be inclined rearward from a rest position. The inclination movement, which runs in a vertical movement plane, is controlled by a linkage in the form of a quadrilateral linkage as a guide mechanism. In this case, a seat carrier, which is connected to a stand, forms a base link and a seat surface, which runs above said seat carrier, approximately parallel thereto, forms a seat link.

At their ends, said links are connected to one another in each case via a front link and a rear link for the purpose of forming the quadrilateral linkage. In this case, as far as the inclination movement is concerned, the rear link is fixed to the backrest, with the result that the first point of rotation is provided by the axis of rotation between the seat carrier or base link and the rear link. Correspondingly, the second point of rotation is provided by the axis of rotation between the rear link and the seat surface or the seat link.

Similarly, in a chair known from EP 0 250 207 B1, the inclination movement of the backrest and the seat surface, which is guided synchronously therewith, is controlled via a quadrilateral linkage. In this chair, the quadrilateral linkage, which controls the inclination movement of the chair, is subjected to the action of a pneumatic spring, which has its ends articulated on the front articulation of the seat link and on the stand, in order to move the seat link back in each case from a rearwardly inclined position into the rest position.

PCT WO 83/00610 also discloses a chair of the type mentioned in the introduction. In this chair, the guide mechanism provided for the inclination movement is likewise a linkage, but in this case in the form of a slider crank, that is to say a three-bar linkage with two rotary articulations and with a rotary/sliding articulation. In this chair too, a pneumatic spring moves the seat link back in each case from a rearwardly inclined position into the rest position. For this purpose, the compression spring, which has one end articulated on the stand or seat carrier, has its other end acting on the rear articulation of the seat link, where the latter is connected to the rear link, which bears the backrest.

SUMMARY OF THE INVENTION

The object of the invention is to develop a chair of the abovementioned type such that a particularly pronounced inclination movement of the backrest with an inclination of, for example, up to 40°—in relation to the starting position of the backrest—is also made possible without the chair tilting rearward via its center of gravity. Furthermore, it is also the intention, even if the backrest is inclined to a particularly great extent of more than 40°, to avoid as far as possible the situation where an individual seated on the chair feels as if he/she is about to topple over.

This object is achieved according to the invention in that, in the rest position, the first point of rotation is positioned at approximately the same height as, or higher than, the second point of rotation.

The invention takes as its departure point the consideration that, in the known chair, the tendency to tilt is promoted, and the angle of inclination which can be achieved by the backrest is thus reduced, in that, as the backrest is inclined rearward, the center of gravity of the chair is likewise displaced rearward to a particularly pronounced extent. This is accentuated, in particular, in that, as the backrest is inclined rearward and downward, the seat surface, which is guided synchronously therewith, is likewise displaced rearward. For just a low tendency to tilt, the chair should thus be designed such that, even as the backrest is inclined rearward to a relatively pronounced extent, the center of gravity is displaced rearward only to a slight extent. Rearward displacement of the center of gravity can be kept to a particularly low level in that, as the backrest is inclined rearward, the seat surface is displaced synchronously forward rather than rearward. This is achieved by the abovementioned arrangement of the first and second points of rotation relative to one another.

The chair is advantageously designed such that, as the backrest is inclined rearward and downward, the second point of rotation moves forward and downward. A rearward and downward inclination of the backrest is accompanied by a forward displacement of the seat surface and lowering of the same. As seen in relative terms, in this case, the first point of rotation (which is stationary in relation to the seat carrier) moves upward in relation to the seat surface, whereas this second point of rotation moves downward in the direction of the seat carrier. Such an arrangement can achieve a particularly comfortable movement sequence during the inclination for the individual using the chair.

In addition, for a particularly straightforward construction, the chair is expediently designed such that the second point of rotation is located level with the seat surface and thus the axis of rotation between the seat surface and backrest, said axis of rotation being defined by said point of rotation, is located in the seat surface.

In a further advantageous configuration, the first point of rotation is located higher than the bottom edge of the seat surface. In addition, for a particularly comfortable feeling of movement for the individual using the chair, a further expedient configuration provides, in the rest position, for the second point of rotation, for appropriate adaptation to the points of rotation in the body, to be arranged approximately beneath a position provided for the ischial tuberosities of the seated individual.

In a particularly, advantageous configuration, the chair is designed such that, as far as the inclination movement is concerned, the synchronism ratio between the seat surface and backrest is approximately 1:3. As the backrest is inclined by approximately 40° in relation to its starting position, this gives an inclination of the seat surface of approximately 13° or 14° in relation to its starting position, the inclination advantageously resulting from a corresponding lowering of the seat surface.

For a design which is particularly favorable in terms of ergonomics, the seat surface, in particular in terms of its dimensions in relation to the position of the first and second points of rotation, is expediently dimensioned such that, as the backrest is inclined rearward and downward, the front edge of the seat surface moves forward and downward.

For a mechanical support and in order to allow the inclination movement of the seat surface, said seat surface is expediently connected to the seat carrier such that it can be rotated about a third point of rotation. In order to allow the forward and downward movement of the seat surface provided during the inclination movement of the backrest, the third point of rotation is expediently guided positively. The positive guidance is advantageously such that, as the backrest is inclined rearward and downward, the third point of rotation moves forward and downward. The positive-guidance dimensions make it possible to adjust the synchronism ratio between the seat surface and the backrest as well as the extent of the forward movement of the seat surface during the inclination of the backrest.

For a particularly straightforward construction, a slotted guide is provided for the positive guidance of the third point of rotation. In this case, an axis of rotation defined by the third point of rotation may be realized in physical terms by a torsion bar which is arranged at a suitable location on the seat surface and has its ends, which are guided positively in the guide slot, oriented beyond the seat surface. In this embodiment, the guide mechanism provided for the inclination movement is thus a linkage of the three-bar type with slotted guide. Alternatively, it is also possible for the third point of rotation to be guided positively via an arm which is arranged on the seat carrier such that it can be rotated about a fourth point of rotation.

The advantages achieved by the invention, in particular, in that the positioning of the first point of rotation in the rest position at approximately the same height as, or higher than, the second point of rotation ensures in a particularly straightforward manner that, as the backrest is inclined rearward, the seat surface moves forward. The rearward displacement of the center of gravity of the chair as a result of the rearward inclination of the backrest is thus at least partially compensated by the forward displacement of the seat surface. Accordingly, even with particularly pronounced inclination of the backrest, the chair only has a particularly low tendency to tilt.

In addition, such an arrangement ensures that, during an inclination of the backrest, rather than tilting rearward to this extent with the effect of toppling over, the individual sitting on the chair is moved into an inclined position, without any great lateral displacement, by rotation about a point of rotation in the body. This allows comparatively pronounced inclination of the backrest, with the seat surface being inclined synchronously, without the seated individual feeling as if he/she is about to topple over.

In addition, the guidance of the third point of rotation in a guide slot allows the adjustment of the synchronism ratio between the seat surface and backrest of approximately 1:3, said ratio providing a particularly comfortable movement sequence, with simultaneous lowering of the front edge of the seat surface as the backrest is inclined rearward.

Exemplary embodiments of the invention are explained in more detail hereinbelow with reference to a drawing, in which:

BRIEF DESCRIPTION OF THE DRAWINGS

Corresponding parts are provided with the same designations in all the figures.

DESCRIPTION OF THE PREFERRED EMBODIMENTS

Figure 1:
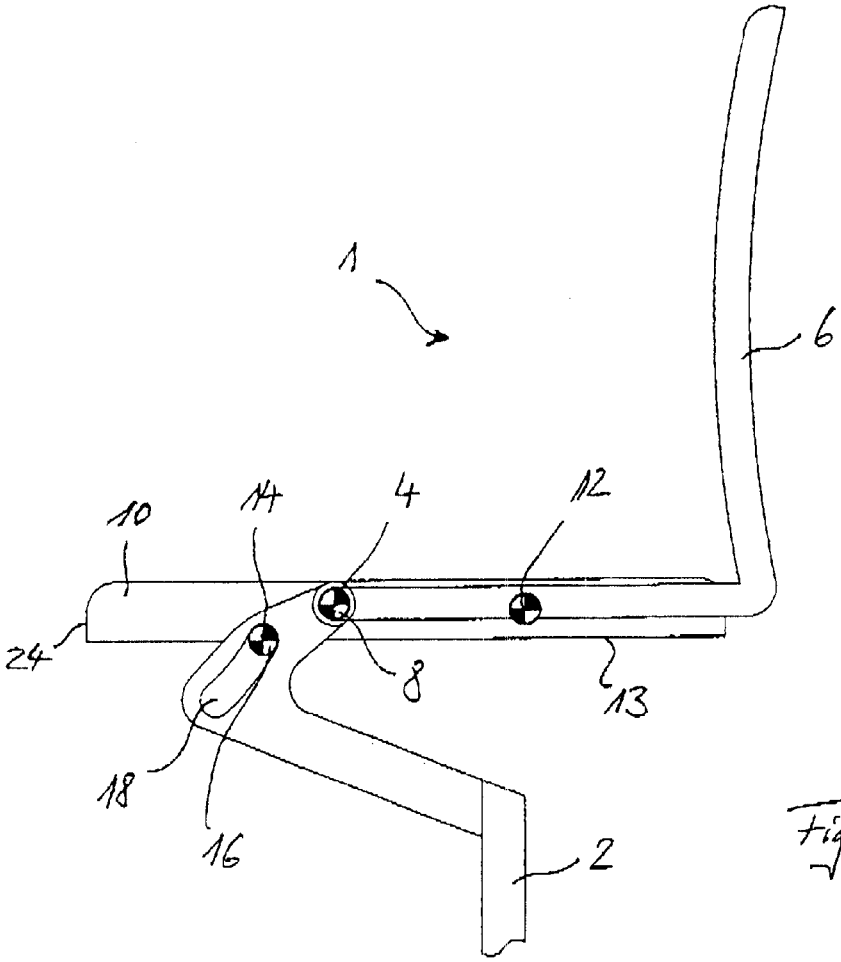
FIG. 1 shows a schematic side view of an office chair in the rest position.
Figure 2:
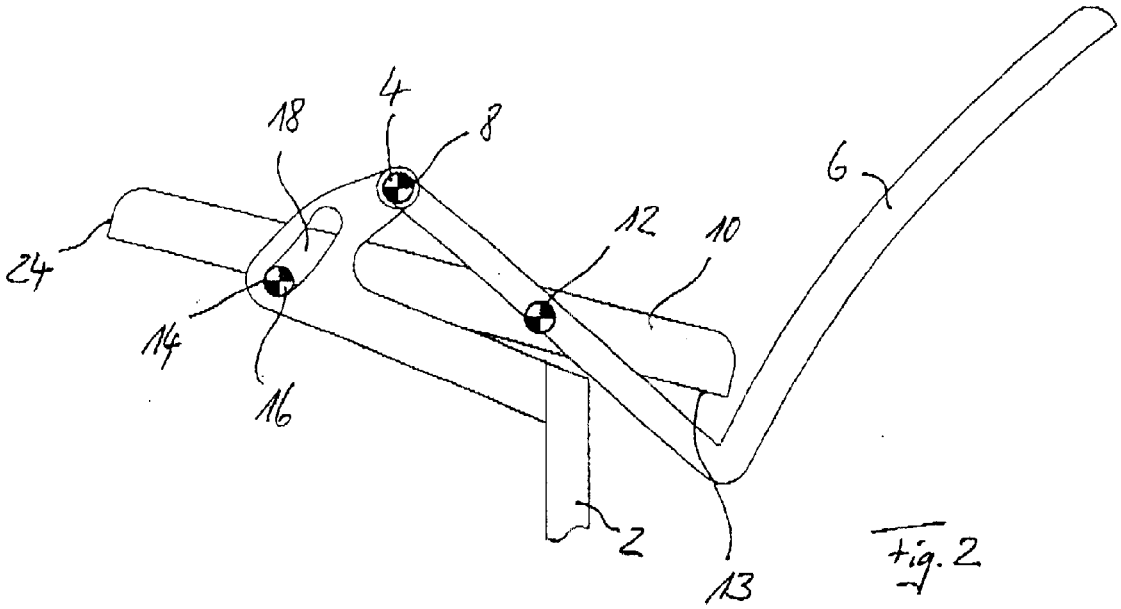
FIG. 2 shows the office chair according to FIG. 1 in the rearwardly inclined end position.

The chair 1, designed as an office chair, according to FIGS. 1 and 2 comprises a seat carrier 2 which is fixed to a stand snot illustrated specifically). A backrest 6 is connected to the seat carrier 2 in a rotatable manner via a rotary pin 4. In this case, the backrest 6 can be inclined rearward from the rest position, which is shown in FIG. 1. The backrest 6 is inclined by a rotation about a first point of rotation 8, which is provided essentially by the center axis of the rotary pin 4.

A seat surface 10 is connected to the backrest 6 such that it can be rotated about a second point of rotation 12. In the exemplary embodiment, the second point of rotation 12 is provided by the center axis of a fastening means (not illustrated specifically) which connects the seat surface 10 physically to the backrest 6. In terms of its lateral position, the second point of rotation 12, in the rest position of the chair 1, is arranged approximately beneath that position assumed by the ischial tuberosities of an individual sitting in the chair 1.

As illustrated in FIG. 1, in the rest position of the chair 1, the first point of rotation 8 is positioned slightly higher than the second point of rotation 12. Alternatively, however, it is also possible for the first point of rotation 8 to be arranged at approximately the same height as, or considerably higher than, the second point of rotation 12. In the exemplary embodiment, the second point of rotation 12 is located in the seat surface 10, with the result that the first point of rotation 8 is likewise arranged above the bottom edge 13 of the seat surface 10.

The seat surface 10 is designed for an inclination movement synchronous with an inclination movement of the backrest 6. A resulting rotation of the seat surface 10 relative to the alignment of the seat carrier 2 is characterized via a third point of rotation 14. In the exemplary embodiment, the third point of rotation 14 is realized physically in a rotary pin 16 arranged beneath the seat surface 10. The rotary pin 16, and with this the third point of rotation 14, are guided positively in a guide slot 18 arranged on the seat carrier 2.

Figure 3:
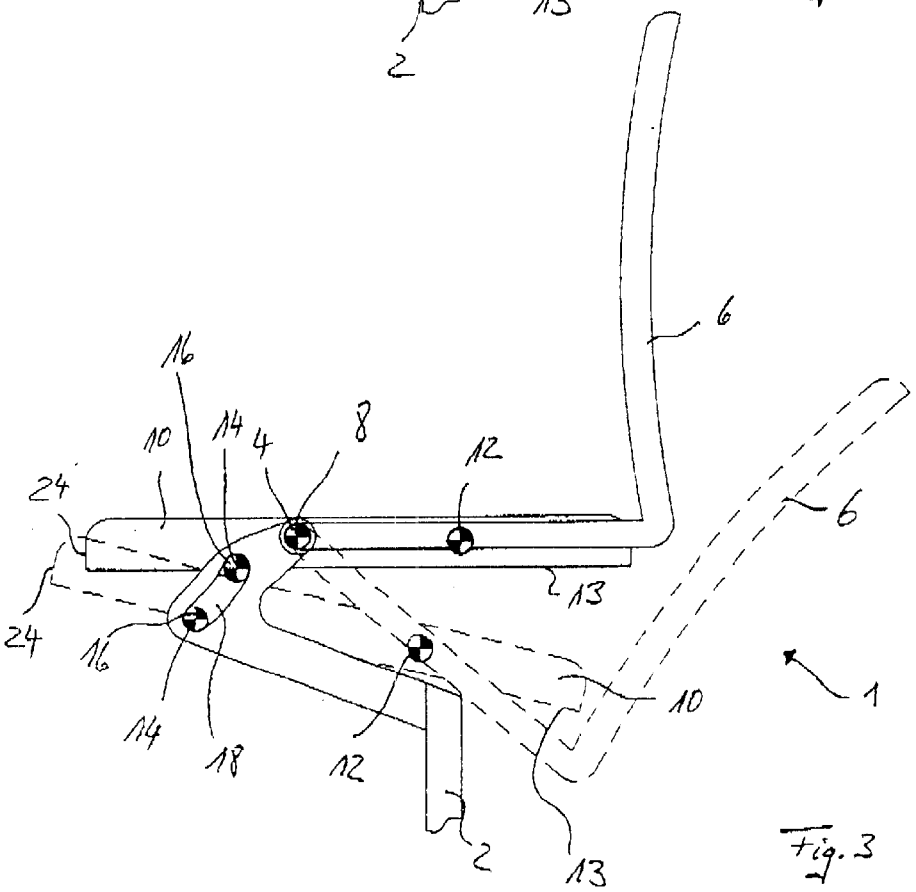
FIG. 3 shows illustrations of the office chair according to FIGS. 1 and 2 in a superposed state.

As can be seen particularly in the comparative illustration according to FIG. 3, the chair 1 is designed such that, as the backrest 6 is inclined rearward (and thus also downward), the second point of rotation 12 moves forward and likewise downward. A rearward inclination of the backrest thus results both in a forward movement of the seat surface 10 and in lowering of the same. The resulting inclination of the seat surface 10 is determined in this case by the change in position of the third point of rotation 14 which occurs as a result of the inclination movement and the guidance in the guide slot 18. As the backrest 6 is inclined rearward, the third point of rotation 14 moves forward and downward as a result of its positive guidance in the guide slot 18.

In terms of the positioning of the points of rotation 8, 12 and 14, the guide slot 18 is dimensioned such that, as far as the inclination movement is concerned, the synchronism ratio between the seat surface 10 and the backrest 6 is approximately 1:3. In other words, the angle of inclination covered by the backrest 6 during its inclination is approximately three times the angle by which the seat surface 10 is inclined during the movement.

For the purpose of moving back into the rest position from the rearwardly inclined position of the backrest 6, the chair 1 is provided with a suitable spring system (not illustrated specifically), for example with a conventional pneumatic spring arranged in or on the seat carrier 2.

Figure 6:
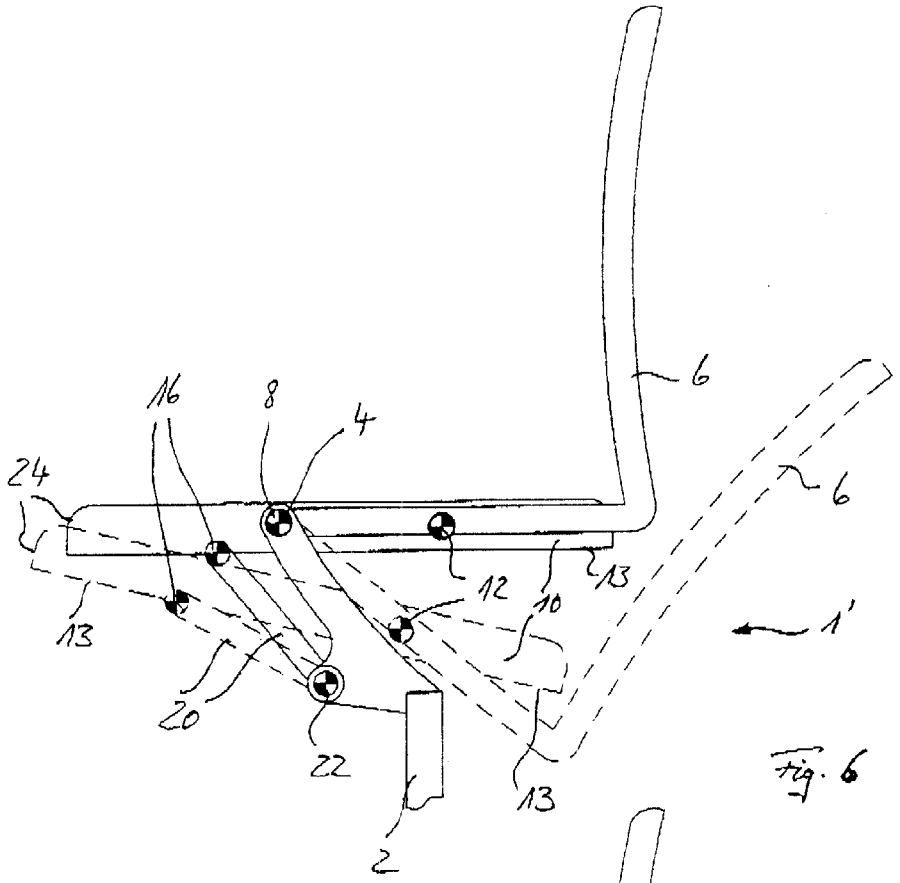
FIG. 6 shows the illustrations of the office chair according to FIGS. 4 and 5 in a superposed state.
Figure 4:
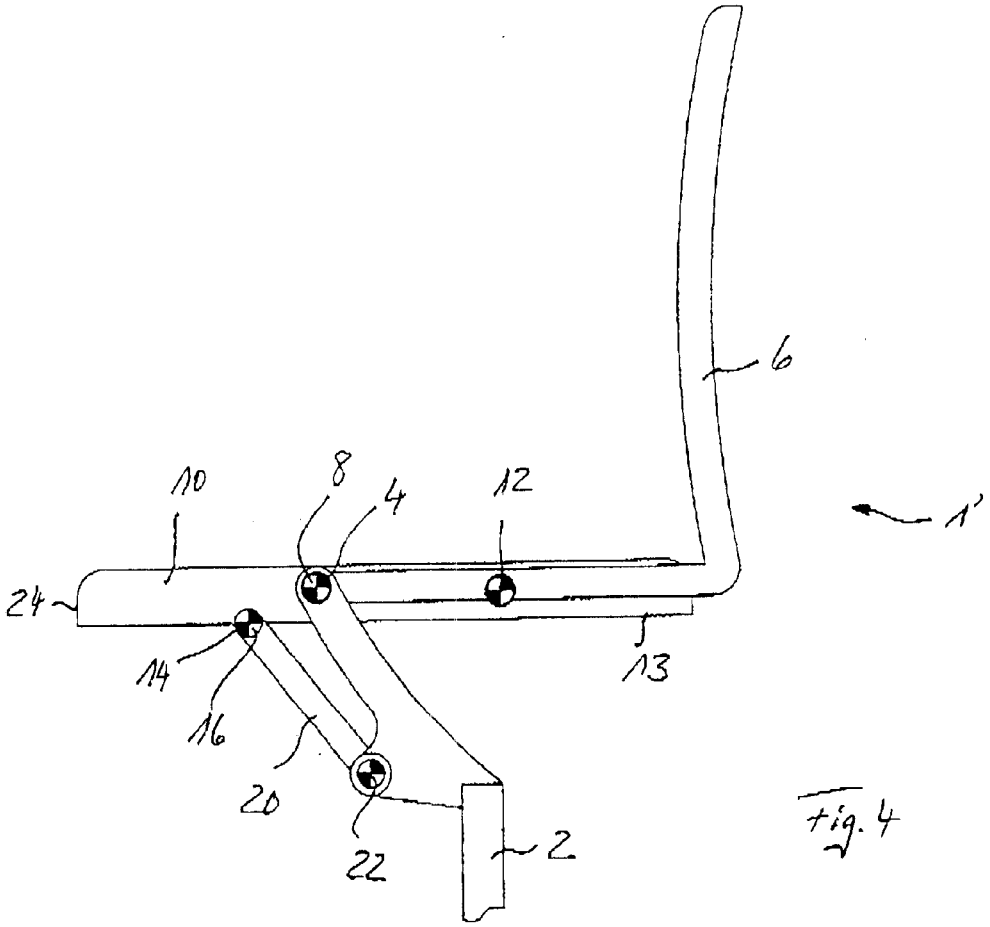
FIG. 4 shows a schematic side view of an alternative embodiment of an office chair in the rest position.
Figure 5:
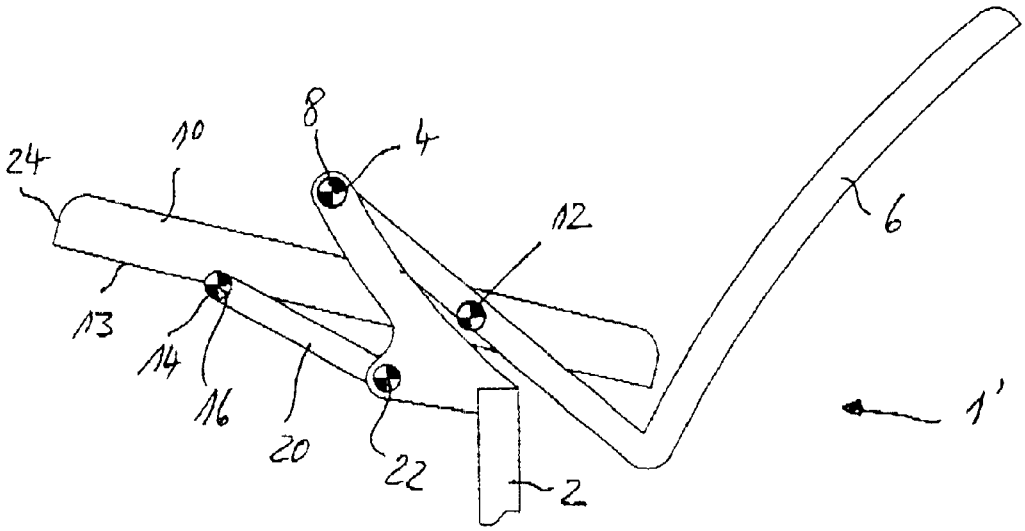
FIG. 5 shows the office chair according to FIG. 4 in the rearwardly inclined end position.

In the exemplary embodiment according to FIGS. 4 to 6, the chair 1', like the chair 1, has a positively guided rotary pin 16 and thus a positively guided third point of rotation 14 between the seat surface 10 and seat carrier 2. In the chair 1', however, an arm 20 is provided for the positive guidance of the third point of rotation 14. In this case, the arm 20 acts on the third point of rotation 14 and, for its part, is arranged with the seat carrier 2 such that it can be rotated about a fourth point of rotation 22. In terms of dimensioning, the arm 20 is likewise dimensioned such that, as far as the inclination movement is concerned, the synchronism ratio between the seat surface 10 and the backrest 6 is approximately 1:3.

On account of the arrangement of the points of rotation 8, 12 in relation to one another, each of the chairs 1, 1' is suitable for a particularly large angle of inclination of the backrest 6. In this case, the backrest may be inclined, for example, up to 40° without the chair toppling over. In accordance with the synchronism ratio between the seat surface 10 and backrest 6 of approximately 1:3, an inclination of the backrest 6 by approximately 40° in relation to the starting position of the backrest 6 results in an inclination of the seat surface 10, as a result of lowering of the same, by approximately 13° or 14° in relation to the starting position of the seat surface 10. In spite of the comparatively pronounced inclination, there is a particularly comfortable feeling of movement for the individual using the chair 1, 1' since, as a result of the backrest 6 and seat surface 10 moving laterally in opposite directions, only a comparatively slight rearward displacement of the center of gravity takes place. The comfortable impression of movement is accentuated in that, in terms of its dimensions, the seat surface 10 is dimensioned such that, as the backrest 6 is inclined rearward and downward, the front edge 24 of the seat surface 10 likewise moves forward and downward.

What is claimed is:

1. A chair, comprising:

a seat carrier;

a backrest pivotally mounted on said seat carrier about a first pivot point relative to said seat carrier for rearwardly inclining said backrest between a position of repose and an inclined position;

a seat surface pivotally connected to said backrest about a second pivot point for inclining said seat surface synchronously with said backrest; and wherein, in the inclined position, said seat surface and said second pivot point are inclined downward and forward to a position bellow said first pivot point; in the position of repose, said first pivot point is positioned substantially at an equal height or higher than said second pivot point, said first pivot point is positioned higher than a bottom edge of said seat surface, and said second pivot point is positioned substantially level with said seat surface.

2. The chair according to claim 1, wherein, as said backrest is inclined rearward and downward, said second pivot point moves forward and downward relative to said seat carrier.

3. The chair according to claim 1, wherein the chair is configured to support a person thereon and wherein, in said position of repose, said second pivot point is disposed approximately beneath a location provided for the ischial tuberosities of a seated person.

4. The chair according to claim 1, wherein the inclining of said backrest results in a change of angle of inclination of said backrest and a change of angle of inclination of said seat surfaces where the change of angle of inclination of said backrest between the position of repose and the inclined position is about three times the change of angle of inclination of said seat surface.

5. The chair according to claim 1, wherein said seat surface has a front edge and, as said backrest is inclined rearward and downward, said front edge of said seat surface moves forward and downward.

6. The chair according to claim 1, wherein a third pivot point is defined as a pivot point between said seat surface and said seat carrier, and said third pivot point is positively guided during an inclination movement of said backrest.

7. The chair according to claim 6, wherein said third pivot point is configured such that, as said backrest moves rearward and downward, said third pivot point moves forward and downward.

8. The chair according to claim 6, wherein said third pivot point is guided positively in a guide slot formed in said seat carrier.

9. The chair according to claim 6, which further comprises an arm pivotally mounted on said seat carrier about a fourth pivot point, and wherein said third pivot point is guided positively via said arm.

10. A chair, comprising:

a seat carrier;

a backrest having a first end being pivotally mounted on said seat carrier about a first pivot point relative to said seat carrier for rearwardly inclining said backrest between a position of repose and an inclined rearward position;

a seat surface directly pivotally connected to said backrest about a second pivot point located at the seat surface, wherein said first pivot point and said second pivot point are configured relative to one another such that when said backrest is inclining rearwardly, said seat surface is synchronously inclined downward and forward and displaced in a location bellow said first pivot point, and said first end of said backrest is displaced above the seat surface and the second pivot point.

11. The chair according to claim 10, wherein, in the position of repose, said first pivot point is positioned substantially at an equal height or higher than said second pivot point.

12. The chair according to claim 10, wherein, as said backrest is inclined rearward and downward, said second pivot point moves forward and downward relative to said seat carrier.

13. The chair according to claim 10, wherein said second pivot point is located substantially level with said seat surface.

14. The chair according to claim 10, wherein said seat surface has a bottom edge and said first pivot point is disposed higher than said bottom edge.

15. The chair according to claim 10, wherein the chair is configured to support a person thereon and wherein, in said position of repose, said second pivot point is disposed approximately beneath a location provided for the ischial tuberosities of a seated person.

16. The chair according to claim 10, wherein said backrest undergoes a change of angle of inclination between the position of repose and the inclined position which is about three times the change of angle of inclination of said seat surface.

17. The chair according to claim 10, wherein said seat surface has a front edge and, as said backrest is inclined rearward and downward, said front edge of said seat surface moves forward and downward.

18. The chair according to claim 10, wherein a third pivot point is defined as a pivot point between said seat surface and said seat carrier, and said third pivot point is positively guided during an inclination movement of said backrest.

19. The chair according to claim 10, wherein said third pivot point is configured such that, as said backrest moves rearward and downward, said third pivot point moves forward and downward.

20. The chair according to claim 10, wherein said third pivot point is guided positively in a guide slot formed in said seat carrier.

* * * * *